US010887714B2

(12) United States Patent
Yoo

(10) Patent No.: US 10,887,714 B2
(45) Date of Patent: Jan. 5, 2021

(54) MICROPHONE AND MANUFACTURING METHOD THEREOF

(71) Applicants: Hyundai Motor Company, Seoul (KR); Kia Motors Corporation, Seoul (KR)

(72) Inventor: Ilseon Yoo, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 196 days.

(21) Appl. No.: 16/116,231

(22) Filed: Aug. 29, 2018

(65) Prior Publication Data

US 2019/0020961 A1 Jan. 17, 2019

Related U.S. Application Data

(62) Division of application No. 14/937,593, filed on Nov. 10, 2015, now abandoned.

(30) Foreign Application Priority Data

Jul. 7, 2015 (KR) ..... 10-2015-0096819

(51) Int. Cl.
*H04R 31/00* (2006.01)
*H04R 1/04* (2006.01)
(Continued)

(52) U.S. Cl.
CPC ..... *H04R 31/006* (2013.01); *H04R 1/04* (2013.01); *H04R 3/005* (2013.01); *H04R 19/005* (2013.01);
(Continued)

(58) Field of Classification Search
CPC ..... H04R 31/00; H04R 31/006; H04R 1/04; H04R 3/005; H04R 19/005; H04R 19/04;
(Continued)

(56) References Cited

U.S. PATENT DOCUMENTS 8,705,777 B2 4/2014 Je et al.
2006/0210106 A1 9/2006 Pedersen
(Continued)

FOREIGN PATENT DOCUMENTS

JP 2008148283 A * 6/2008 ..... H04R 31/00
JP 5108533 B2 12/2012
(Continued)

*Primary Examiner* — A. Dexter Tugbang
(74) *Attorney, Agent, or Firm* — Mintz Levin Cohn Ferris Glovsky and Popeo, P.C.; Peter F. Corless

(57) ABSTRACT

A manufacturing method for a microphone is provided. The microphone includes a case that is vibrated by a vibration signal. A sound inlet through which a sound signal is input is formed at a portion of the case and a first sound element is formed in the case at a position corresponding to the sound inlet. The first sound element receives the sound signal and the vibration signal to output a first initial signal. A second sound element is formed to be adjacent to the first sound element and receives the vibration signal to output a second initial signal. A semiconductor chip is connected to the first sound element and the second sound element and receives the first initial signal and the second initial signal to output a final signal.

5 Claims, 17 Drawing Sheets

(51) Int. Cl.

| | |
|---|---|
| ***H04R 3/00*** | (2006.01) |
| ***H04R 19/00*** | (2006.01) |
| ***H04R 19/04*** | (2006.01) |
| ***H04S 7/00*** | (2006.01) |

(52) U.S. Cl.
CPC ..... *H04R 19/04* (2013.01); *H04R 31/00* (2013.01); *H04S 7/00* (2013.01); *H04R 2499/13* (2013.01); *H04S 2420/01* (2013.01); *Y10T 29/49005* (2015.01)

(58) Field of Classification Search
CPC . H04R 2499/13; Y10T 29/49005; H04S 7/00; H04S 2420/01
See application file for complete search history.

(56) References Cited

U.S. PATENT DOCUMENTS

| | | | | |
|---|---|---|---|---|
| 2008/0037768 | A1 | 2/2008 | Hsu et al. | |
| 2010/0054495 | A1 | 3/2010 | Harney et al. | |
| 2012/0250897 | A1 | 10/2012 | Michel et al. | |
| 2012/0326249 | A1 | 12/2012 | Rombach | |
| 2013/0070951 | A1 | 3/2013 | Tanaka et al. | |
| 2013/0094675 | A1* | 4/2013 | Je ..... | H04R 31/006 381/174 |
| 2013/0101143 | A1 | 4/2013 | Chen et al. | |
| 2015/0125003 | A1 | 5/2015 | Wiesbauer et al. | |
| 2015/0292970 | A1 | 10/2015 | Gando et al. | |
| 2016/0119704 | A1 | 4/2016 | Brown et al. | |
| 2017/0121173 | A1 | 5/2017 | Hoekstra | |

FOREIGN PATENT DOCUMENTS

| | | | |
|---|---|---|---|
| KR | 10-1993-0015944 | A | 7/1993 |
| KR | 2004-0014688 | A | 2/2004 |
| KR | 2014-0135349 | A | 11/2014 |

* cited by examiner

MICROPHONE AND MANUFACTURING METHOD THEREOF

CROSS-REFERENCE TO RELATED APPLICATION

This application is a Divisional Application of U.S. patent application Ser. No. 14/937,593 filed on Nov. 10, 2015 which claims priority to and the benefit of Korean Patent Application No. 10-2015-0096819 filed in the Korean Intellectual Property Office on Jul. 7, 2015, the entire contents of which are incorporated herein by reference.

BACKGROUND OF THE DISCLOSURE

(a) Field of the Disclosure

The present disclosure relates to a microphone and a manufacturing method thereof. More particularly, the present disclosure relates to a microphone using a plurality of sound elements to output a highly sensitive sound signal in a vehicle and a manufacturing method thereof.

(b) Description of the Related Art

Recently, microphones, which convert a voice into an electrical signal, have been downsized. Many downsized microphones are being developed based on a microelectromechanical system (MEMS) technology. Such an MEMS microphone has stronger humidity resistance and heat resistance than a conventional electret condenser microphone (ECM), and may be downsized and integrated with a signal processing circuit.

When extracting only a voice signal, ambient noise serves as interference. Thus, a technology that can remove the noise of a surrounding environment is required. A typical method of removing the ambient noise obtains a noise spectrum characteristic in a non-voice range by using one sound element, and estimates a noise spectrum in a voice range using the obtained noise spectrum characteristic to remove the noise by extracting noise from a signal in which the voices and the noise are mixed.

However, conventional microphones are effective only when a statistical characteristic of the ambient noise is stationary. For example, a statistical characteristic of the ambient noise may be constant with respect to time, and an effect is insufficient for a noise with a non-stationary characteristic, for example, a time-variable characteristic such as voices of people around and/or music sounds. Further, since a harsh noise due to each time-variant noise remains, clarity of sound may be reduced. Particularly, performance of microphones of a hands-free device and a voice recognition device used in a vehicle may be reduced due to vibration signals generated in the vehicle.

The above information disclosed in this Background section is only to enhance the understanding of the background of the disclosure, and therefore, it may contain information that does not form the related art that is already known in this country to a person of ordinary skill in the art.

SUMMARY OF THE DISCLOSURE

The present disclosure provides a microphone and a manufacturing method thereof that improves a signal-to-noise ratio (SNR) using a plurality of sound elements to output a highly sensitive sound signal in a vehicle in which a sound signal and a vibration signal simultaneously exist.

Embodiments of the present disclosure provide a microphone including: a case that is vibrated by a vibration signal, a sound inlet through which a sound signal is input being formed at a portion of the case; a first sound element that is formed in the case at a position corresponding to the sound inlet and receives the sound signal and the vibration signal to output a first initial signal; a second sound element that is formed to be adjacent to the first sound element and receives the vibration signal to output a second initial signal; and a semiconductor chip that is connected to the first sound element and the second sound element and receives the first initial signal and the second initial signal to output a final signal.

The semiconductor chip may: i) divide the first initial signal into a sound signal and a vibration signal, ii) modulate a phase of the second initial signal, iii) merge the first initial signal with the divided sound signal and vibration signal, and iv) merge the second initial signal with the phase-modulated signal to cancel the vibration signal and extract the sound signal.

An air passage may be formed at a side of a lower portion of the second sound element.

The case may include: a lower case in which the sound inlet is formed; and an upper case that is formed on the lower case and forms a predetermined accommodating space to accommodate the first sound element, the second sound element, and the semiconductor chip.

The lower case and the upper case may be made of a metal material.

The first sound element may include: a substrate in which a first space is formed; a first vibration film that is formed on the substrate; a first fixed electrode that is formed above the first vibration film to be spaced apart from the first vibration film at a predetermined interval; an insulating layer that is formed on the first fixed electrode; a supporting layer that supports the first fixed electrode and the insulating layer, an exposing hole being formed at a side of the supporting layer to partially expose the first vibration film; and a pad that is formed on the insulating layer, some of the exposed portion of the first vibration film, and some of an exposed portion of the first fixed electrode.

The insulating layer may be made of a silicon nitride material.

The second sound element may include: a substrate in which a second space is formed; a second vibration film that is formed on the substrate; a second fixed electrode that is formed above the second vibration film to be spaced apart from the second vibration film at a predetermined interval; an insulating layer that is formed on the second fixed electrode; a supporting layer that supports the second fixed electrode and the insulating layer, an exposing hole being formed at a side of the supporting layer to partially expose the second vibration film; and a pad that is formed on the insulating layer, some of the exposed portion of the second vibration film, and some of an exposed portion of the second fixed electrode.

A plurality of contact holes may be vertically formed in the semiconductor chip, and the first sound element and the second sound element are electrically connected through connecting portions formed inside the plurality of contact holes.

The semiconductor chip may include an application specific integrated circuit (ASIC).

Furthermore, according to embodiments of the present disclosure, a manufacturing method of a microphone includes: forming a first oxide layer and a second oxide layer on a substrate; forming a first vibration film and a second vibration film on upper portions of the first oxide layer and the second oxide layer; forming a sacrificial layer on the substrate, the first vibration film, and the second vibration film; forming a plurality of depressed portions in the sacrificial layer by patterning an upper portion of the sacrificial layer to correspond to the first vibration film and the second vibration film; forming a first fixed electrode and a second fixed electrode on the sacrificial layer; forming exposing holes that respectively partially expose the first vibration film and the second vibration film by patterning the sacrificial layer; forming an insulating layer on the sacrificial layer, the first fixed electrode, and the second fixed electrode; forming a pad on the insulating layer; forming an air passage at a side of a lower portion of the substrate corresponding to the second vibration film by forming a first photosensitive film on the lower portion of the substrate and then etching the substrate with the first photosensitive film as a mask; forming a first space and a second space by removing the first photosensitive film, forming a second photosensitive film, and then etching the substrate with the second photosensitive film as a mask; forming a supporting layer by removing some of the sacrificial layer corresponding to the first space and the second space; and bonding a semiconductor chip in which a plurality of connecting portions are formed to the pad.

A plurality of slots may be formed in the first vibration film and the second vibration film.

The first fixed electrode and the second fixed electrode may include a plurality of protrusions corresponding to the plurality of depressed portions.

In the forming of the first fixed electrode and the second fixed electrode, a plurality of air inlets may be formed in the first fixed electrode and the second fixed electrode.

In the bonding of the semiconductor chip, the semiconductor chip is bonded to the pad by applying eutectic bonding to the pad.

<Description of symbols>

Figure 1:
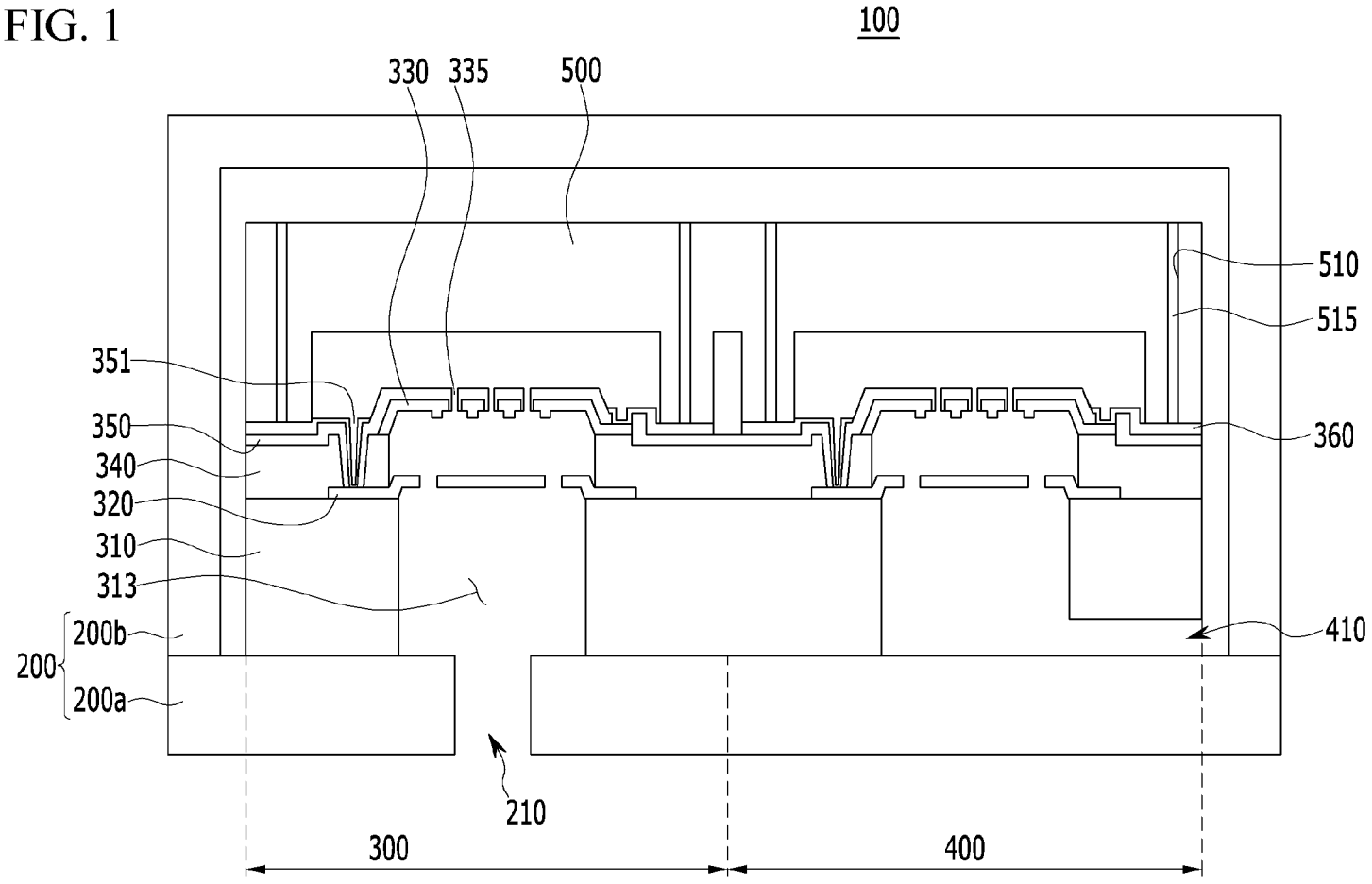
FIG. 1 illustrates a schematic diagram of a microphone according to embodiments of the present disclosure.

| | |
|---|---|
| 100: microphone | 200a: lower case |
| 200b: upper case | 210: sound inlet |
| 300: first sound element | 310: substrate |
| 313: first space | 315: first oxide layer |
| 320: first vibration film | 330: first fixed electrode |
| 333: protrusion | 335: air inlet |
| 340: supporting layer | 341: oxide layer |
| 343: depressed portion | 350: insulating layer |
| 351: exposing hole | 360: pad |
| 400: second sound element | 410: air passage |
| 415: second oxide layer | 430: second fixed electrode |
| 431: second space | 500: semiconductor chip |
| 510: contact hole | 515: connecting portion |

DETAILED DESCRIPTION OF THE EMBODIMENTS

Hereinafter, embodiments of the present disclosure will be described with reference to the accompanying drawings. The drawings to be described below and the following detailed description are simply provided for effectively explaining the characteristics of the present disclosure. Therefore, the present disclosure should not be construed as being limited to the drawings and the following description.

Further, in the description of the present disclosure, the detailed description of related well-known configurations and functions is not provided when it is determined as unnecessarily making the scope of the present disclosure unclear. Further, the terminologies to be described below are ones defined in consideration of their function in the present disclosure and may be changed by the intention of a user, an operator, or a custom. Therefore, their definition should be made on the basis of the description of the present disclosure.

Further, in the following embodiments, the terminologies are appropriately changed, combined, or divided so that those skilled in the art can clearly understand them, in order to efficiently explain the main technical characteristics of the present disclosure, but the present disclosure is not limited thereto.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Referring now to the disclosed embodiments, FIG. 1 illustrates a schematic diagram of a microphone according to embodiments of the present disclosure.

As shown in FIG. 1, a microphone 100 according to an exemplary embodiment of the present disclosure includes a case 200, a first sound element 300, a second sound element 400, and a semiconductor chip 500.

The case 200 may include a lower case **200*a* and an upper case 200*b***, and may be vibrated by a vibration signal. The vibration signal may be generated by a vibration in a vehicle.

A sound inlet 210 through which a sound signal is inputted is provided in some of the lower case **200*a***. The sound signal may be generated depending on a command of a driver's voice.

The upper case **200*b* is mounted on the lower case 200*a*, and forms a predetermined receiving space to accommodate the first sound element 300, the second sound element 400, and the semiconductor chip 500**.

The lower case 200*a* and the upper case 200*b* may be made of a metal material. For example, the lower case 200*a* may be formed of a printed circuit board (PCB) substrate, and the upper case 200*b* may be formed of a metal cap.

The case 200 provided with the lower case 200*a* and the upper case 200*b* may be wholly formed in a cylindrical or square-tubular shape.

The first sound element 300 is formed at a position corresponding to the sound inlet 210 in the case 200. For example, the first sound element 300 is formed to be connected to the sound inlet 210.

The first sound element 300 receives a sound signal and a vibration signal, and then outputs a first initial signal. The first initial signal is transmitted to the semiconductor chip 500, and is divided into the sound signal and the vibration signal by the semiconductor chip 500.

The second sound element 400 is formed to be adjacent to the first sound element 300. The second sound element 400 receives a vibration signal, and then outputs a second initial signal. An air passage 410 is formed at one side of a lower portion of the second sound element 400. Since the sound inlet 210 is formed, although the first sound element 300 receives the sound signal and the vibration signal, the second sound element 400 may not receive the sound signal.

The second initial signal is transmitted to the semiconductor chip 500, and a phase of the second initial signal is modulated by the semiconductor chip 500. The first sound element 300 and the second sound element 400 may be formed by using a microelectromechanical system (MEMS) technology, as an example.

The first sound element 300 and the second sound element 400 are respectively provided with a substrate 310, a vibration film 320, and a fixed electrode 330.

The substrate 310 may be made of silicon, and a space 313 is formed in the substrate 310.

The vibration film 320 is formed on the substrate 310 to be exposed by the space 313, and is vibrated by the sound signal inputted from the sound inlet 210 of the lower case 200*a*.

The fixed electrode 330 is disposed to be spaced apart from the vibration film 320 at a predetermined interval, and include a plurality of air inlets 335. For example, the vibration film 320 and the fixed electrode 330 are formed to be spaced apart from each other at a predetermined interval, and the space formed by the predetermined interval forms an air layer.

An insulating layer 350 is formed on the fixed electrode 330. The insulating layer 350 may be made of a silicon nitride material.

A supporting layer 340 may be formed between the vibration film 320 and the fixed electrode 330. The supporting layer 340 serves to support the fixed electrode 330 and the insulating layer 350 on the substrate 310 and the vibration film 320, and an exposing hole 351 may be formed at one side of the supporting layer 340 to expose one portion of the vibration film 320.

A pad 360 may be formed on the insulating layer 350 and the exposed portions of the vibration film 320 and the fixed electrode 330. The pad 360 is made of a metal material, and serves to bond the semiconductor chip 500 to the first and second sound elements 300 and 400.

The semiconductor chip 500 is electrically connected to the first sound element 300 and the second sound element 400. The semiconductor chip 500 receives the first initial signal and the second initial signal, and then outputs a final signal.

A signal process by the semiconductor chip 500 will now be described in detail with reference to FIGS. 16 and 17.

The semiconductor chip 500 may be an application specific integrated circuit (ASIC). A plurality of contact holes 510 may be vertically formed in the semiconductor chip 500.

The contact hole 510 for electrical connection is electrically connected to the first sound element 300 and the second sound element 400 by forming a connecting portion 515 inside the contact hole 510.

The connecting portion 515 may be formed by inserting an electrical material or an electrode into the contact hole 510.

The semiconductor chip 500 is bonded to the first and second sound elements 300 and 400 through the pad 360 which is disposed on the first and second sound elements.

FIGS. 12 to 15 illustrate cross-sectional views of sequential processes of a manufacturing method for manufacturing a microphone according to embodiments of the present disclosure.

The first sound element 300 and the second sound element 400 of the microphone 100 according to the embodiments of the present disclosure may be respectively formed on one side and the other side of the substrate 310 to be adjacent to each other.

Although it will now be exemplarily described that the first sound element 300 and the second sound element 400 are respectively formed on the substrate 310 to be adjacent to each other, the present disclosure is not limited thereto, and positions of the first sound element 300 and the second sound element 400 may be changed as necessary, or they may be respectively formed on two substrates.

Figure 2:
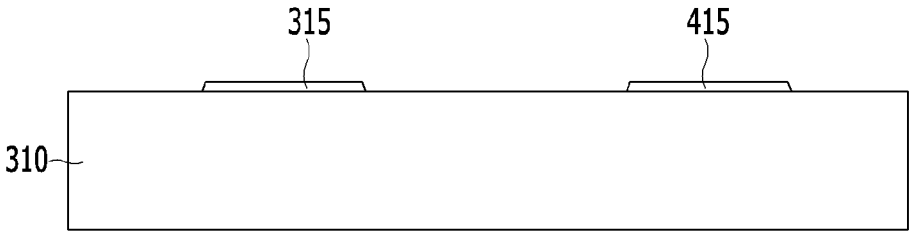
FIGS. 2 to 15 illustrate sequential processing diagrams of a manufacturing method for manufacturing a microphone according to embodiments of the present disclosure.

First, as shown in FIG. 2, a first oxide layer 315 and a second oxide layer 415 are formed by depositing an oxide on the substrate 310 and then patterning the deposited oxide.

Figure 3:
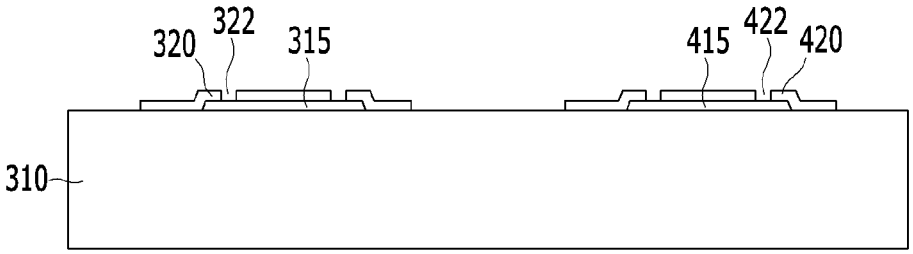

As shown in FIG. 3, a first vibration film 320 and a second vibration film 420 are respectively formed on the first oxide layer 315 and second oxide layer 415. For example, it is possible to form a polysilicon layer or a vibrating layer made of a conductive material on the substrate 310, the first oxide layer 315, and the second oxide layer 415 and then form a photosensitive layer on the vibrating layer. Subsequently, the first vibration film 320 and the second vibration film 420 may be formed by exposing and developing the photosensitive layer to form a photosensitive layer pattern and then etching the vibrating layer with the photosensitive layer pattern as a mask.

A plurality of slots 322 and 422 may be formed in the first vibration film 320 and the second vibration film 420.

Figure 4:
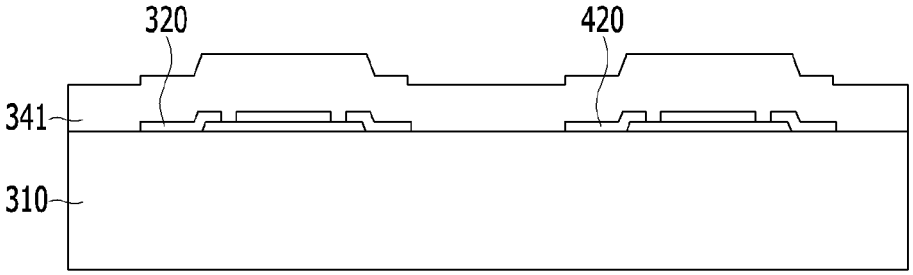

As shown in FIG. 4, a sacrificial layer 341 is formed on the substrate 310, the first vibration film 320, and the second vibration film 420.

After an air passage 410 described later is formed, the sacrificial layer 341 is partially etched to form a supporting layer 340 supporting the fixed electrodes 330 and 430 at upper edges of the vibration films 320 and 420.

Figure 5:
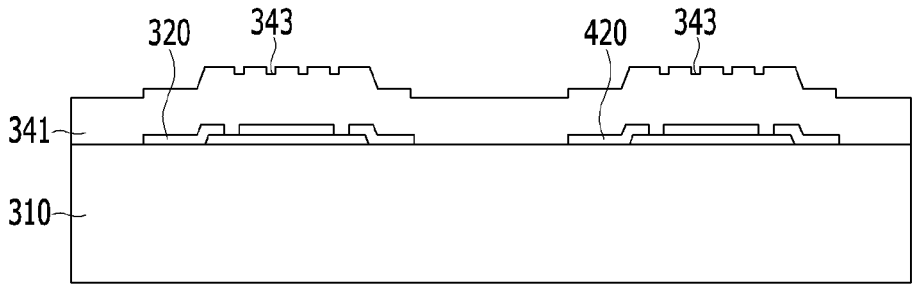

As shown in FIG. 5, a plurality of depressed portions 343 are formed by patterning an upper portion of the sacrificial layer 341 corresponding to the first vibration film 320 and the second vibration film 420.

Figure 6:
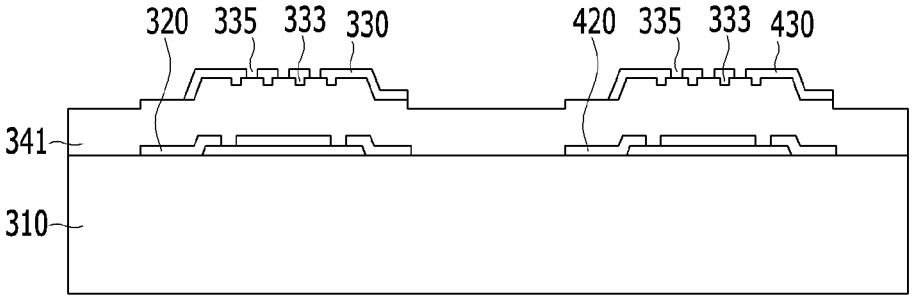

As shown in FIG. 6, the first fixed electrode 330 and the second fixed electrode 430 are formed on the sacrificial layer 341 on which the plurality of depressed portions 343 corresponding to the first vibration film 320 and the second vibration film 420 are respectively formed. The fixed electrodes 330 and 430 respectively include a plurality of protrusions 333 corresponding to the plurality of depressed portion 343.

A plurality of air inlets 335 are respectively formed at the fixed electrodes 330 and 430.

Figure 7:
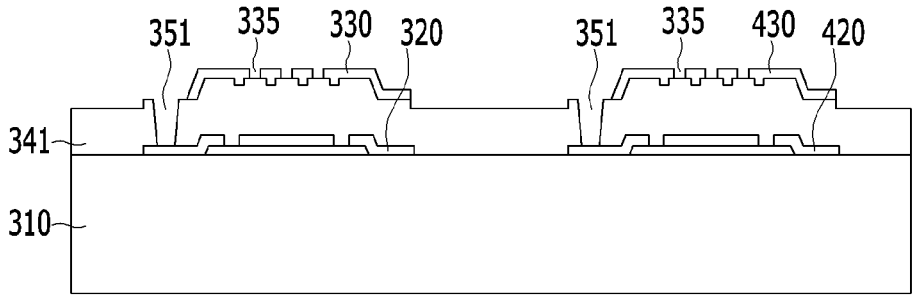

As shown in FIG. 7, exposing holes 351 that partially expose the first and second vibration films 320 and 420 are formed by patterning the sacrificial layer 341. The exposing holes 351 are those that partially expose the first and second vibration films 320 and 420 for electrical connection.

Figure 8:
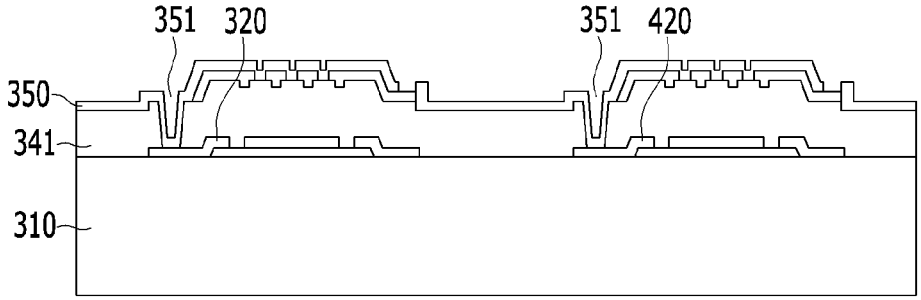

As shown in FIG. 8, an insulating layer 350 is formed on the sacrificial layer 341 and the fixed electrodes 330 and 430. The insulating layer 350 may be made of a silicon nitride material.

Figure 9:
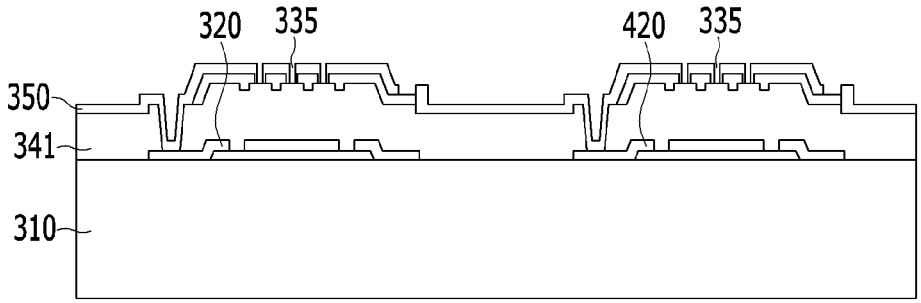

As shown in FIG. 9, portions of the insulating layer 350 corresponding to the air inlets 335 of the fixed electrodes 330 and 430 are exposed by patterning the insulating layer 350.

Figure 10:
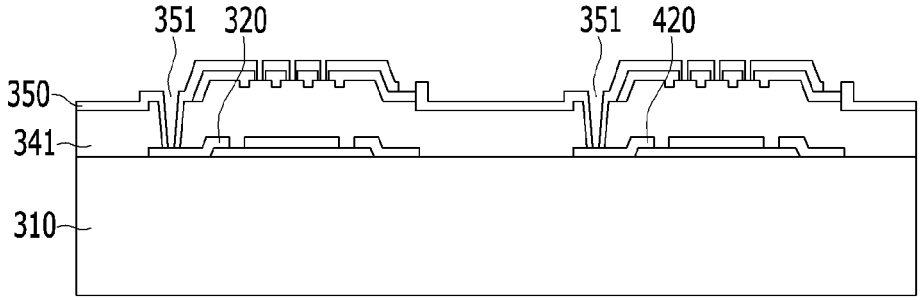

Subsequently, as shown in FIG. 10, the vibration films 320 and 420 corresponding to the exposing holes 351 and the fixed electrodes 330 and 430 are partially exposed by patterning the insulating layer 350. The exposing of the fixed electrodes 330 and 430 is performed for electrical connection like the forming of the exposing holes 351 of the vibration films 320 and 420.

Figure 11:
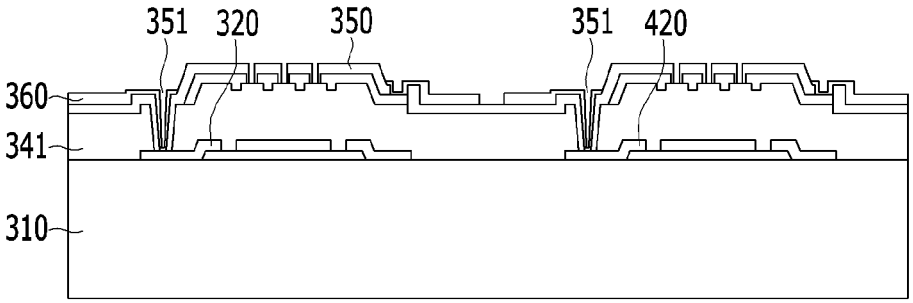

As shown in FIG. 11, after depositing a metal material on the insulating layer 350, a pad 360 is formed by patterning the deposited metal material. The pad 360 is used to bond a semiconductor chip 500 described later.

Figure 12:
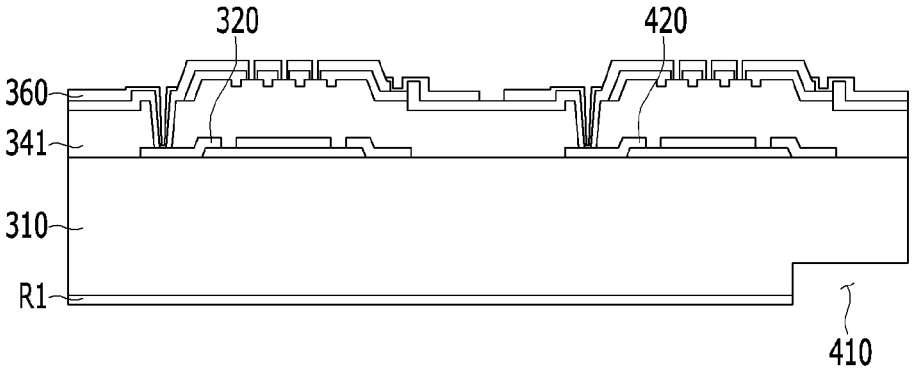

As shown in FIG. 12, after forming a first photosensitive film R1 on a lower portion of the substrate 310, an air passage 410 is formed at one side of the lower portion of the substrate 310 corresponding to the second vibration film 420 by etching the substrate 310 with the first photosensitive film R1 as a mask.

Figure 13:
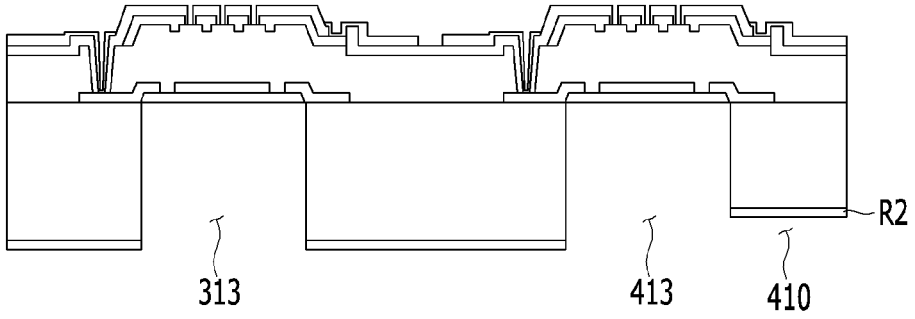

As shown in FIG. 13, after removing the first photosensitive film R1 and forming a second photosensitive film R2, a first space 313 and a second space 413 are respectively formed by etching the substrate 310 with the second photosensitive film R2 as a mask. Next, the second photosensitive film R2 is removed.

Figure 14:
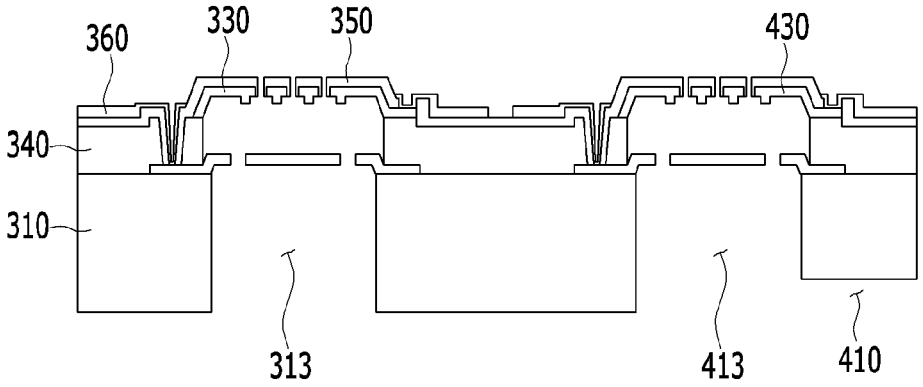

As shown in FIG. 14, the first and second oxide layers 315 and 415 are removed. Next, a supporting layer 340 is formed by removing some of the sacrificial layer 341 corresponding to the first and second spaces 313 and 413. The supporting layer 340 serves to support the fixed electrodes 330 and 430 at the upper edges of the vibration films 320 and 420.

Figure 15:
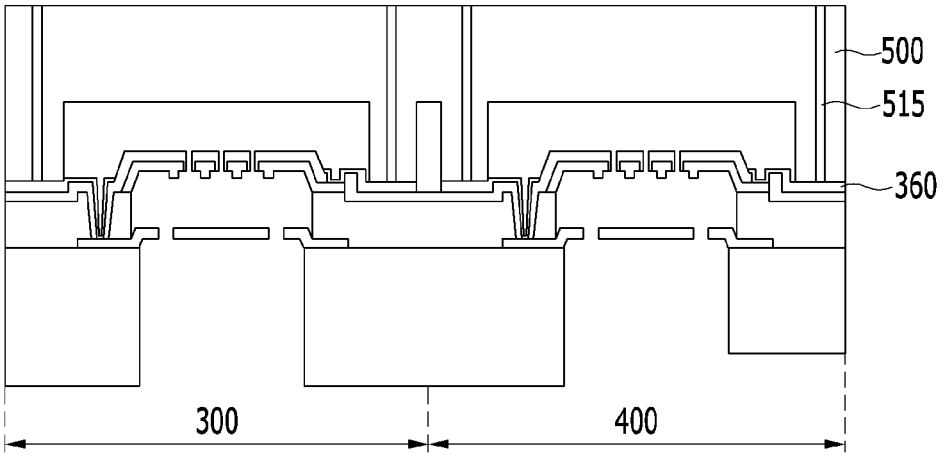

Finally, as shown in FIG. 15, the semiconductor chip 500 in which a plurality of connecting portions 515 are formed is bonded to the pad 360. The semiconductor chip 500 may be bonded to the pad 360 by applying eutectic bonding to the pad 360.

In the microphone 100 according to embodiments of the present disclosure manufactured by the above-described manufacturing method, a portion that includes the first vibration film 320, the first space 313, and the first fixed electrode 330 forms the first sound element 300, and a portion that includes the second vibration film 420, the second space 413, and the second fixed electrode 430 forms the second sound element 400.

Therefore, the first sound element 300 and the second sound element 400 are formed to be adjacent to each other, and a sound signal and a vibration signal may be processed by one semiconductor chip 500 formed above them.

Figure 16:
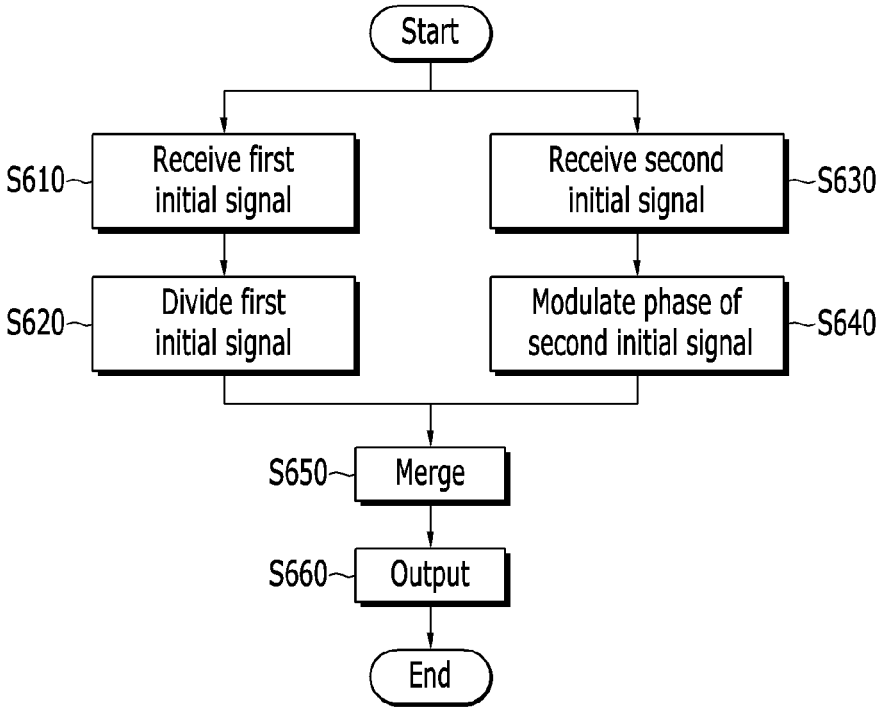
FIG. 16 illustrates a flowchart of a method through which a semiconductor chip of a microphone according to embodiments of the present disclosure processes a signal.
Figure 17:
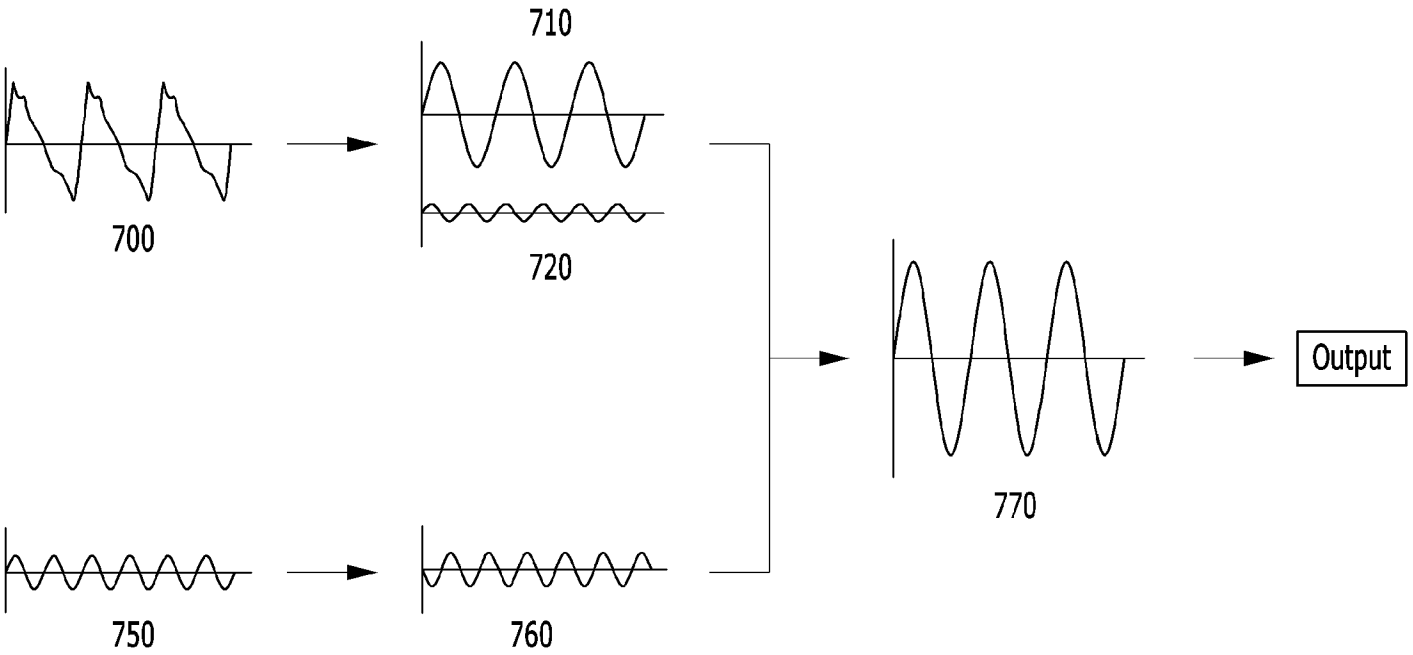
FIG. 17 illustrates a drawing for explaining a method through which a semiconductor chip of a microphone according to embodiments of the present disclosure processes a signal.

FIG. 16 illustrates a flowchart of a method through which a semiconductor chip of a microphone according to embodiments of the present disclosure processes a signal, and FIG. 17 illustrates a drawing for explaining a method through which a semiconductor chip of a microphone according to embodiments of the present disclosure processes a signal.

The semiconductor chip 500 receives a first initial signal 700 from the first sound element 300 (S610). In other words, the first sound element 300 receives a sound signal and a vibration signal from the outside, and then outputs the first initial signal 700 to the semiconductor chip 500.

Subsequently, the semiconductor chip 500 divides the first initial signal 700 into a sound signal 710 and a vibration signal 720 (S620).

The semiconductor chip 500 then receives a second initial signal 750 from the second sound element 400 (S630). In other words, the second sound element 300 receives a vibration signal from the outside, and then outputs the second initial signal 750 to the semiconductor chip 500.

Next, the semiconductor chip 500 modulates a phase of the second initial signal 750, and generates a modulated vibration signal 760 (S640). Subsequently, the semiconductor chip 500 merges the first initial signal 700 and second initial signal 750 (S650). In other words, the semiconductor chip 500 merges the sound signal 710 and the vibration signal 720 into which the first initial signal 700 is divided and the vibration signal 760 to which the second initial signal 750 is phase-modulated, thereby cancelling the vibration signal and simultaneously extracting the sound signal.

Finally, the semiconductor chip 500 may output a final signal 770 by amplifying the extracted sound signal (S660).

According to the embodiments of the present disclosure described hereinabove, it is possible to improve the signal-to-noise ratio (SNR) by cancelling the vibration signal and improving the sensitivity of the sound signal based on at least two of sound elements in the vehicle in which the sound signal and the vibration signal simultaneously exist.

While this disclosure has been described in connection with what is presently considered to be practical embodiments, it is to be understood that the disclosure is not limited to the disclosed embodiments, but, on the contrary, is intended to cover various modifications and equivalent arrangements included within the spirit and scope of the appended claims.

What is claimed is:

1. A manufacturing method of a microphone, comprising:

forming a first oxide layer and a second oxide layer on a substrate;

forming a first vibration film and a second vibration film on upper portions of the first oxide layer and the second oxide layer;

forming a sacrificial layer on the substrate, the first vibration film, and the second vibration film;

forming a plurality of depressed portions in the sacrificial layer by patterning an upper portion of the sacrificial layer to correspond to the first vibration film and the second vibration film;

forming a first fixed electrode and a second fixed electrode on the sacrificial layer;

forming exposing holes in the sacrificial layer that respectively partially expose the first vibration film and the second vibration film by patterning the sacrificial layer;

forming an insulating layer on the sacrificial layer, the first fixed electrode, and the second fixed electrode;

forming a pad on the insulating layer;

forming an air passage at a side of a lower portion of the substrate corresponding to the second vibration film by forming a first photosensitive film on the lower portion of the substrate and then etching the lower portion of the substrate with the first photosensitive film as a mask;

forming a first space and a second space by removing the first photosensitive film, forming a second photosensitive film, and then etching the substrate with the second photosensitive film as a mask;

forming a supporting layer by removing some of the sacrificial layer corresponding to the first space and the second space; and bonding a semiconductor chip in which a plurality of connecting portions are formed to the pad.

2. The manufacturing method of the microphone of claim 1, wherein a plurality of slots are formed in the first vibration film and the second vibration film.

3. The manufacturing method of the microphone of claim 1, wherein the first fixed electrode and the second fixed electrode include a plurality of protrusions corresponding to the plurality of depressed portions.

4. The manufacturing method of the microphone of claim 1, wherein in the forming of the first fixed electrode and the second fixed electrode, a plurality of air inlets are formed in the first fixed electrode and the second fixed electrode.

5. The manufacturing method of the microphone of claim 1, wherein in the bonding of the semiconductor chip, the semiconductor chip is bonded to the pad by applying eutectic bonding to the pad.

* * * * *